US008454397B2

(12) United States Patent
Nishi et al.

(10) Patent No.: US 8,454,397 B2
(45) Date of Patent: Jun. 4, 2013

(54) ANTI-WICKING TERMINAL AND CONNECTOR

(75) Inventors: Norihiro Nishi, Kanagawa (JP); Kazushige Asakawa, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/808,535

(22) PCT Filed: Dec. 22, 2008

(86) PCT No.: PCT/US2008/088002
§ 371 (c)(1),
(2), (4) Date: Aug. 4, 2011

(87) PCT Pub. No.: WO2009/082734
PCT Pub. Date: Jul. 2, 2009

(65) Prior Publication Data

US 2011/0287666 A1 Nov. 24, 2011

(30) Foreign Application Priority Data

Dec. 20, 2007 (JP) ..... 2007-328529

(51) Int. Cl.
*H01R 4/02* (2006.01)

(52) U.S. Cl.
USPC ..... 439/876

(58) Field of Classification Search
USPC ..... 439/876, 83
See application file for complete search history.

(56) References Cited

U.S. PATENT DOCUMENTS

| | | | | | |
|---|---|---|---|---|---|
| 2,926,328 | A | * | 2/1960 | Flanagan, Jr. | 439/636 |
| 3,230,297 | A | * | 1/1966 | Means | 174/262 |
| 3,525,972 | A | * | 8/1970 | Kinkaid et al. | 439/381 |
| 3,718,895 | A | * | 2/1973 | Reynolds et al. | 439/853 |
| 3,864,004 | A | * | 2/1975 | Friend | 439/844 |
| 3,989,331 | A | * | 11/1976 | Hanlon | 439/70 |
| 4,010,992 | A | * | 3/1977 | Crimmins et al. | 439/70 |
| 4,037,899 | A | * | 7/1977 | Crowell | 439/82 |
| 4,183,611 | A | * | 1/1980 | Casciotti et al. | 439/876 |
| 4,533,187 | A | * | 8/1985 | Kirkman | 439/83 |
| 4,722,470 | A | * | 2/1988 | Johary | 228/180.21 |
| 4,723,923 | A | * | 2/1988 | Senor et al. | 439/853 |
| 4,756,696 | A | * | 7/1988 | Whiteman, Jr. | 439/79 |
| 4,828,515 | A | * | 5/1989 | Senor et al. | 439/862 |
| 4,891,023 | A | * | 1/1990 | Lopata | 439/637 |
| 4,935,454 | A | * | 6/1990 | Koblitz et al. | 522/24 |
| 4,948,030 | A | * | 8/1990 | Chason et al. | 228/118 |
| 5,192,228 | A | * | 3/1993 | Collins et al. | 439/567 |
| 5,209,681 | A | * | 5/1993 | Brown | 439/876 |
| 5,367,124 | A | * | 11/1994 | Hoffman et al. | 174/552 |
| 5,395,250 | A | * | 3/1995 | Englert et al. | 439/65 |

(Continued)

FOREIGN PATENT DOCUMENTS

| | | | |
|---|---|---|---|
| EP | 298410 | * | 1/1989 |
| JP | 2002-042817 | | 8/2003 |

*Primary Examiner* — Neil Abrams
(74) *Attorney, Agent, or Firm* — Timothy M. Morella

(57) ABSTRACT

An electrically conductive terminal includes a solder tail configured to be soldered to a contact pad of a circuit member and at least one deflectable contact arm. Each deflectable arm is configured to engage a counterpart terminal of a mating electrical component. A body having a pair of side edges and oppositely facing side surfaces is provided between and connects the solder tail and the contact arm. Each side surface has a pair of non-parallel channels therein with at least one of the channels extending between the pair of side edges.

19 Claims, 15 Drawing Sheets

U.S. PATENT DOCUMENTS 5,425,658 A * 6/1995 White ..... 439/637
5,453,017 A * 9/1995 Belopolsky ..... 439/83
5,495,669 A * 3/1996 Legrady et al. ..... 29/885
5,538,448 A * 7/1996 Tsao ..... 439/874
5,588,885 A * 12/1996 Gotz et al. ..... 439/876
5,611,699 A * 3/1997 Tanigawa ..... 439/78
5,702,255 A * 12/1997 Murphy et al. ..... 439/71
5,791,929 A * 8/1998 Banakis et al. ..... 439/342
5,842,875 A * 12/1998 Yagi ..... 439/74
5,934,951 A 8/1999 Lai et al.
5,971,774 A * 10/1999 Kuki et al. ..... 439/79
6,042,389 A * 3/2000 Lemke et al. ..... 439/74
6,171,156 B1 * 1/2001 Lin et al. ..... 439/876
6,206,706 B1 * 3/2001 Lee et al. ..... 439/74
6,227,877 B1 * 5/2001 Mou et al. ..... 439/83
6,241,535 B1 * 6/2001 Lemke et al. ..... 439/83
6,247,635 B1 * 6/2001 Olson ..... 228/118
6,712,625 B2 4/2002 Saito et al.
6,386,892 B1 * 5/2002 Hsu ..... 439/83
6,488,513 B1 * 12/2002 Neidich et al. ..... 439/66
6,800,545 B2 * 10/2004 Downes ..... 438/612
7,080,451 B2 * 7/2006 Saito et al. ..... 29/874
7,172,438 B2 * 2/2007 Vicich et al. ..... 439/83
7,195,495 B2 * 3/2007 Takano et al. ..... 439/74
7,195,498 B1 * 3/2007 Wang et al. ..... 439/83
7,601,012 B2 * 10/2009 Ju ..... 439/83
7,625,244 B2 * 12/2009 Midorikawa ..... 439/660
8,129,227 B2 * 3/2012 Tellkamp ..... 438/123
2011/0287666 A1 * 11/2011 Nishi et al. ..... 439/660

* cited by examiner

FIG. 5A
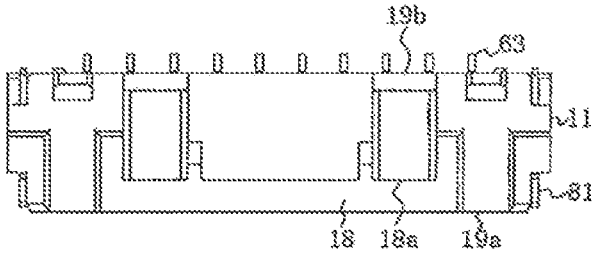
FIG. 5B
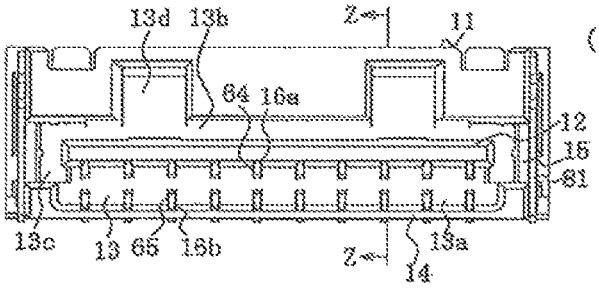
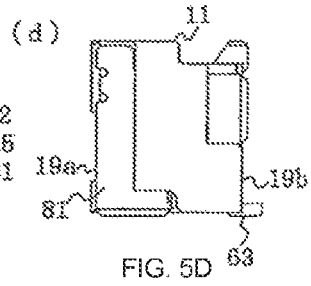
FIG. 5D
FIG. 5C
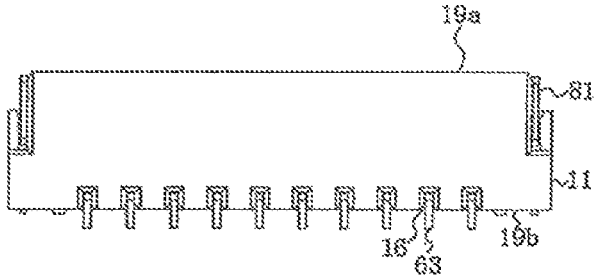

ANTI-WICKING TERMINAL AND CONNECTOR

BACKGROUND OF THE INVENTION

The Present Invention generally relates to surface mount connectors and, more particularly, to a surface mount connector with improved anti-wicking characteristics.

A pair of connectors are often used to connect cables including a plurality of conductive wires to a circuit member such as a printed circuit board. A first type of cable connector is provided with a plurality of terminals configured to contact the conductive wires in the cable. A second type of connector is mounted on the circuit member and has terminals with solder tails, each being connected to a contact pad provided on the surface of the board via reflow soldering. During the reflow process whereby the solder tails are connected to the pads of the board, solder may wick onto the side surfaces of the terminals and contaminate the contact portion of the terminals. In order to avoid such solder wicking, a terminal has been proposed in which a channel or groove is formed on the surface thereof in order to reduce such solder wicking.

Referring to FIG. 15 (and Japanese Patent Application Laid-Open (Kokai) 6-13145), a terminal 851 of an integrated circuit socket is mounted by press-fitting such terminal into a press-fit groove 812 formed in base member 811. Terminal 851 is an integrally formed member having a substantially U-shape and includes a contact section 851*a* and a body section 851*b* separated from each other in the vertical direction of the base member 811. The body section 851*b* includes a fixed section 852 with one end connected to a coupling part of the contact section 851*a*, an angled section 853 connected to the other end of the fixed section, and a solder tail 854 connected to the angled section 853. Press-fit projections 855 are formed on both sides of the fixed section 852.

The distance b1 between the tips of the press-fit projections 855 is larger than the width b2 of first groove 813 in the press-fit groove 812 into which the fixed section 852 is press-fit. When the press-fit projections 855 engage the side surface of the first groove 813, they securely fix the terminal 851 to the base member 811. The width c1 of the angled section 853 is larger than the width c2 of second groove 814 in the press-fit groove 812. Thus, when the fixed section 852 is press-fit in the first groove 813, the angled section 853 is press-fit in the second groove 814 so as to further securely fix the terminal 851 to the base member 811.

A groove 851*c* configured to reduce solder wicking is formed in a portion located at a midpoint of the body section 851*b*. When solder wicks up the angled section 853 during soldering of solder tail 854 to the contact pad of a board (not shown), the solder is blocked by the groove 851*c* thus preventing further solder wicking.

However, in practice, the conventional terminal 851 might suffer from so-called flux-wicking where flux contained in the solder wicks up the side surface of the terminal 851 when the solder tail 854 is soldered to the contact pad on the surface of a board via reflow soldering. In the molten state, flux has a higher flowability than solder and therefore, formation of the groove 851*c* alone may prevent occurrence of solder-wicking but has difficulty in preventing the flux from wicking. If flux-wicking occurs and the flux contacts the contact section 851*a*, the contact section 851*a* may be sufficiently contaminated to prevent a reliable contact between contact section 851*a* and a counterpart terminal (not shown).

SUMMARY OF THE INVENTION

An object of the Present Invention is to solve the above-mentioned problems encountered by conventional terminals and connectors through the use of a simple, reliable terminal adapted for use in a connector and being configured to reduce the likelihood of flux-wicking by virtue of a plurality of non-parallel grooves or channels formed in a body thereof. The body has extending therefrom a solder tail to be soldered to a contact pad and a contact portion. The contact portion is protected from contamination by flux through such non-parallel channels. Another aspect of the Present Invention is that the strength of the body is not significantly reduced by such channels. Still another object of the Present Invention is to provide a connector incorporating therein the above-mentioned reliable terminal or terminals.

In order to achieve the above-mentioned object, the Present Invention provides a terminal adapted for use in a connector, including a solder tail to be soldered, at least one contact arm configured to contact a counterpart terminal, and a body provided between the solder tail and the contact arm, wherein the body has opposite side surfaces with each including a plurality of non-parallel channels formed therein.

A terminal according to another aspect of the Present Invention is provided wherein each of the channels extends in a direction across a path between the solder tail and the contact arm. A terminal according to still another aspect of the Present Invention is provided wherein at least one of the channels is formed so as to extend from one edge of the terminal to another edge. If desired, the terminal may have a thickened part formed between two of the channels. In still another aspect, the channels In accordance with the Present Invention, a plurality of channels are formed to be non-parallel to each other in the body of the terminal from which a solder tail and a contact arm extend. By appropriately positioning the channels, it is thus possible to provide a simple, reliable anti-wicking terminal in which the contact portion of the terminal will not be contaminated by flux, and without a moving part thereof being bonded to a terminal receiving cavity by the flux, and without lowering in the strength of the body, thereby enhancing the reliability.

Still another aspect is to provide an electrically conductive terminal configured for use in a connector that includes a solder tail configured to be soldered to a contact pad of a circuit member and at least one deflectable contact arm. The deflectable arm is configured to engage a counterpart terminal of a mating electrical component. A body having a pair of side edges and oppositely facing side surfaces is provided between and connects the solder tail and the contact arm. Each side surface has a pair of non-parallel channels therein with at least one of the channels extending between the pair of side edges.

If desired, the terminal may include a pair of deflectable contact arms and each of the channels extends in a direction across a path from the solder tail to one of the contact arms. If desired, the solder tail may be configured to be surface mount soldered to the contact pad of the circuit member. If desired, both of the channels may extend between the pair of side edges. If desired, the terminal may be stamped from sheet metal and be planar. If desired, at least one of the channels may be linear. If desired, the side edges of the base may be generally perpendicular to each other. If desired, the terminal may include a pair of non-parallel intersecting linear channels. If desired, each of the pair of non-parallel intersecting linear channels may extend to one of the side edges. If desired, the pair of non-parallel intersecting linear channels may be configured to intersect with the linear channel. If desired, the channels may be configured in a K-shape. If desired, a plurality of such terminals may be provided in a housing having an insertion opening into which a mating electrical component may be inserted and a plurality of spaced apart terminal receiving cavities into which the plurality of the terminals are be inserted.

The invention can be better understood with reference to the following drawings. The components in the drawings are not necessarily to scale, emphasis instead being placed upon clearly illustrating the principles of the Present Invention.

BRIEF DESCRIPTION OF THE DRAWINGS

FIG. 5A is a top plan view of the connector of FIG. 1;

FIG. 5B is a front view of the connector of FIG. 1;

FIG. 5C is a bottom view of the connector of FIG. 1;

FIG. 5D is a side view of the connector of FIG. 1;

DESCRIPTION OF THE PREFERRED EMBODIMENTS

Figure 1:
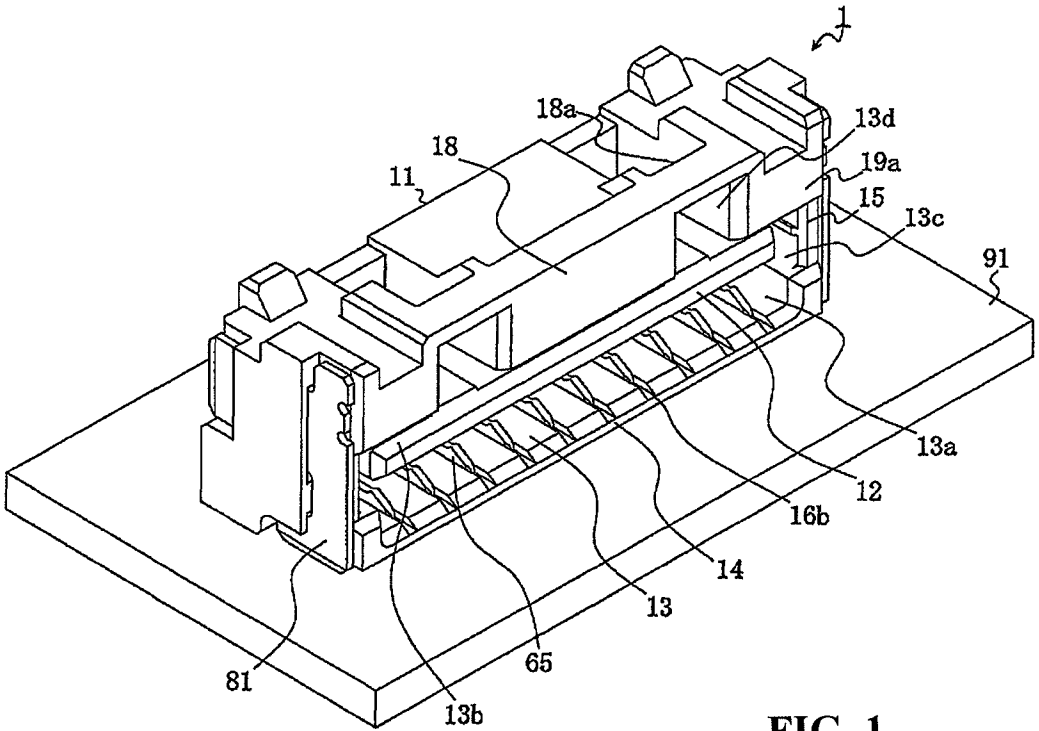
FIG. 1 is a perspective view of the connector according to a first embodiment of the Present Invention as viewed generally from the mating side thereof.
Figure 2:
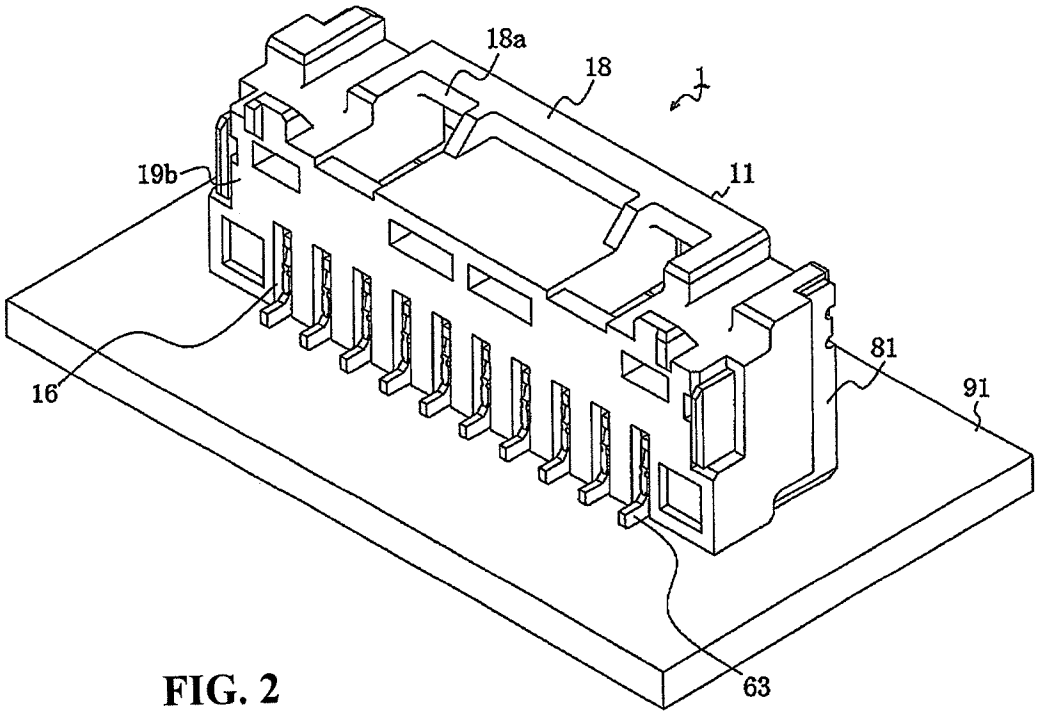
FIG. 2 is a perspective view of the connector of FIG. 1 but from a rear side thereof.

Preferred embodiments are described in detail below with reference to the accompanying drawings in which like reference numerals designate corresponding components throughout the several views.

Figure 3:
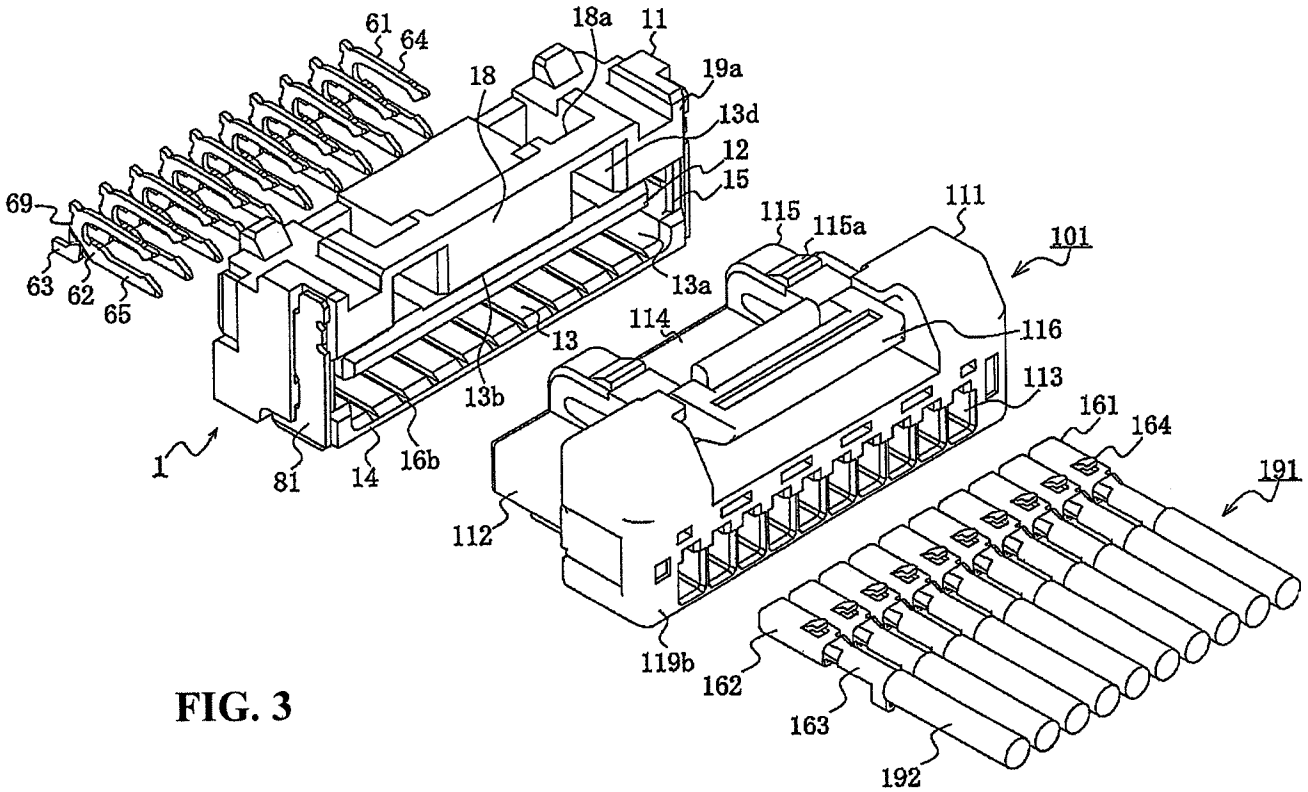
FIG. 3 is an exploded perspective view of the connector of FIG. 1 together with a counterpart mating connector.
Figure 4:
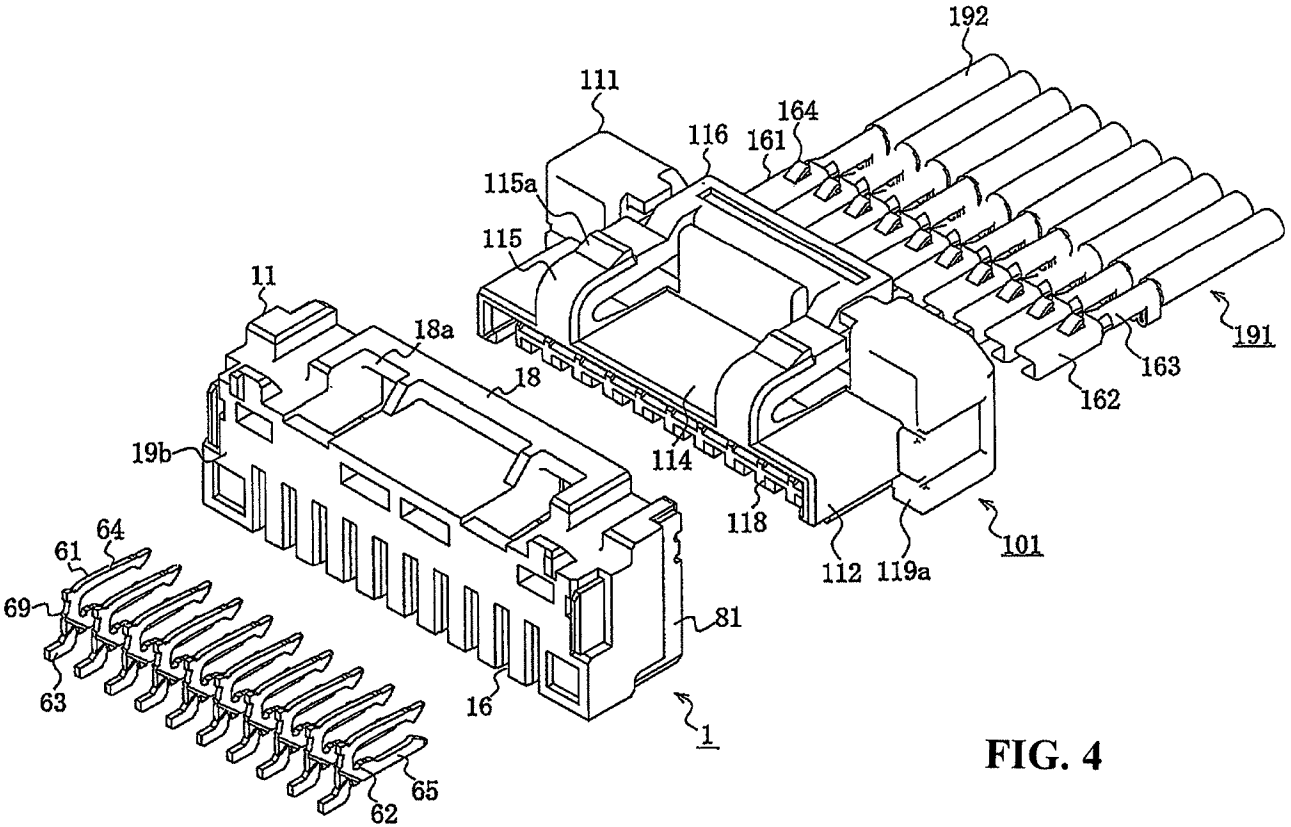
FIG. 4 is an exploded perspective view similar to that of FIG. 3 but taken from the same perspective as FIG. 2.

Referring to FIGS. 1-4, board connector 1 is mounted on the surface of circuit member or board 91 in accordance with an embodiment of the Present Invention. As is typical board connector 1 is configured to mate with corresponding cable connector 101. As best illustrated in FIGS. 3-4, cable connector 101 receives plurality of terminated cables 191.

Board 91 may be, for example, a printed circuit board used in an electronic device such as a computer or an electric appliance such as a home electronics product, but may also be of any other currently-known type of board. A plurality of contact pads (not shown) are arranged side by side at a predetermined pitch or spacing and are exposed on the surface of board 91. Each contact pad is connected to a conductive trace (not shown) of board 91.

Cable 191 may either be one of various types of circuit members or may be any type of cable or cables, for example, a rigid board, an FPC (Flexible Printed Circuit) or a flat flexible cable usually referred to as an FFC (Flexible Flat Cable), ribbon cable or individual cables. As illustrated, cable 191 is comprised of a plurality of cables, each including conductive wire 192 having a substantially circular cross-section, and including a conductive core wire (not shown) arranged in the center thereof and an insulating outer coating covering the circumference of the core wire.

For purposes of the Present Invention, representations of direction, such as up, down, left, right, front, rear and the like, used for explaining the structure and movement of each part of board connector 1, cable connector 101 and other members are not absolute, but relative. These representations are appropriate when each part of board connector 1, cable connector 101 and other members are in the positions shown in the Figures. If the orientations of board connector 1, cable connector 101 or other members change, these representations are to be changed according to such change in orientation.

Board connector 1 is preferably a receptacle connector including housing 11 integrally formed of an insulating material. Housing 11 is configured to receive plurality of metallic terminals 61, and includes receptacle or insertion opening 13 dimensioned to receive cable connector 101. Insertion opening 13 is defined vertically and horizontally by top wall 18, bottom wall 14 and side walls 15. Insertion opening 13 extends through front surface 19*a* of housing 11. Mating projection 112 of cable connector 101 is inserted into insertion opening 13. Planar partition plate 12 is positioned inside insertion opening 13 and extends in the width direction. The space between partition plate 12 and bottom wall 14 is referred to as insertion space 13*a*; between partition plate 12 and top wall 18 is upper space 13*b*; and between partition plate 12 and side plate 15 is side space 13*c*. Lock insertion space 13*d*, into which locking part 115 of cable connector 101 is inserted, communicates with upper space 13*b*. Top wall 18 includes locking shoulder 18*a* against which engaging projection 115*a* of locking part 115 is engaged.

Plurality of groove-shaped terminal receiving cavities 16 extend from rear surface 19*b* of housing 11 to front surface 19*a* thereof, and receive and hold terminal 61. Terminal receiving cavities 16 are arranged side by side in the width direction of housing 11 at a predetermined pitch, for example, a pitch of about 1.2 mm. Each terminal receiving cavity 16 includes upper terminal receiving cavity 16*a*, formed in the lower surface of partition plate 12, and lower terminal receiving cavity 16*b*, formed in the upper surface of bottom wall 14. The width of each terminal receiving cavity 16 is preferably greater than the thickness of its respective terminal 61, so that the terminal 61 may be mounted with essentially no side-to-side movement or play.

In this embodiment, it is preferable that terminals 61 are integrally formed by stamping or blanking out of sheet metal, and each is generally channel-shaped or U-shaped and approximately as thick as the sheet metal from which it was stamped. Terminal 61 includes body 69, solder tail 63—as a soldering portion extending from the lower side to the rear side of body 69, upper arm part 64—as a first contact arm part extending from the upper front end of body 69, and lower arm part 65—as a second contact arm extending from the lower front end of body 69. Relatively rigid base part 62 of body 69 is configured to fix terminal 61 to housing 11. A portion of upper arm part 64 is accommodated in upper terminal receiving cavity 16*a* and another portion thereof protrudes downward past the lower surface of partition plate 12 and is positioned in insertion space 13*a*. A portion of lower arm part 65 is accommodated in lower terminal receiving cavity 16*b*, and another portion thereof protrudes upward from the upper surface of bottom wall 14 and is positioned in terminal insertion space 13*a*. A portion of solder tail 63 is accommodated in terminal receiving cavity 16, and another portion thereof protrudes rearward from the lower end of rear surface 19*b* of housing 11.

Board connector 1, as shown in FIGS. 1-4, is preferably a right-angle type connector. Board connector 1 is mounted laterally on board 91 with the lower surface of housing 11, shown in FIG. 5C, opposed to or facing the surface of board 91. Insertion opening 13 extends parallel to board 91, and front surface 19*a* and rear surface 19*b* of housing 11 are substantially vertical with respect to board 91. Solder tails 63 of terminals 61 are soldered to respective contact pads on the surface of board 91 with the lower surface of solder tails 63 opposed to the contact pads. Fitting or solder nails 81, used as auxiliary metallic brackets, are attached to both side surfaces of housing 11. Each of solder nails 81 is soldered to a fixing pad exposed on the surface of board 91 with the lower surface of each solder nail 81 opposed to the fixing pad. Board connector 1 is thus fixed to board 91.

While soldering of solder tails 63 and solder nails 81 is described as reflow soldering method in this example, the soldering process may be made by way of any currently-known type of soldering method. During processing, solder paste containing flux is applied to the surfaces of the contact pads and the fixing pads on the surface of board 91. Board connector 1 is then placed on the surface of board 91 so that the lower surfaces of solder tails 63 and solder nails 81 are opposed to the surfaces of contact pads and the fixing pads, respectively. Board 91, having board connector 1, thereon is carried into a furnace where the solder paste is heated and melted to solder tails 63 and solder nails 81.

Cable connector 101 includes housing or body 111 integrally formed of an insulating material, such as a synthetic resin. Mating projection 112 extends from front surface 119*a* of housing 111. Plurality of hole-shaped terminal receiving cavities 113 extend through housing 111 from rear surface 119*b* to front surface 119*a*, and receive and hold mating terminals 161, each mating terminal 161 being connected to a tip of each conductive wire 192 of assembly of cables 191.

Terminal 161 is integrally formed of a conductive material such as sheet metal. Terminal 161 includes contact part 162—configured to engage terminal 61, core wire connection part 163—extending rearward from the rear end of contact portion 162 and connected to a tip of the core wire of each of conductive wires 192, and engaging section 164—projecting upward from the upper surface of contact part 162 and secured to housing 111. Each terminal 161 is inserted into terminal receiving cavity 113 from the rear of housing 111, and engaging section 164 engages housing 111 to secure terminals 161 in housing 111.

Mating projection 112 includes connecting projection 118—configured to hold contact portions 162 of terminals 161, and projection cover part 114—configured to cover the upper portion and side portion of connecting projection 118. When cable connector 101 is mated to board connector 1, connecting projection 118 is inserted into terminal insertion space 13*a* together with counterpart contact portions 162, and projection cover part 114 is inserted into upper space 13*b* and side space 13*c*. Contact portions 162 engage portions of upper arm part 64 and lower arm part 65 of terminals 61 protruding into terminal insertion space 13*a*. This allows terminal 61 to be electrically connected to terminal 161.

Pair of locking arms 115 are spaced apart from each other in the width direction and integrally formed on the upper surface of projection cover part 114. Locking arms 115 are cantilever-shaped members whose front ends are connected to the front end of the upper surface of projection cover part 114, and whose rear ends are free. Locking arms 115 include, on the upper surface thereof, engagement projection 115*a* integrally formed and protruding upward. When cable connector 101 is mated to board connector 1, locking part 115 is inserted into lock insertion space 13*d*, engagement projection 115*a* engages locking shoulder 18*a* of top wall 18, and cable connector 101 is locked to board connector 1.

In this embodiment, a locking mechanism comprised of top wall 18 of board connector 1 and locking arms 115 of cable connector 101 is a positive lock. During the locking operation, it is unnecessary to manipulate top wall 18 or locking arms 115. However, during the unlocking operation, it is necessary for an operator to depress locking arms 115. Coupling member 116 is integrally connected to the free ends of locking arms 115 to couple locking arms 115 so as to allow simultaneous manipulation of locking arms 115 with a single movement of coupling member 116.

Figure 6B:
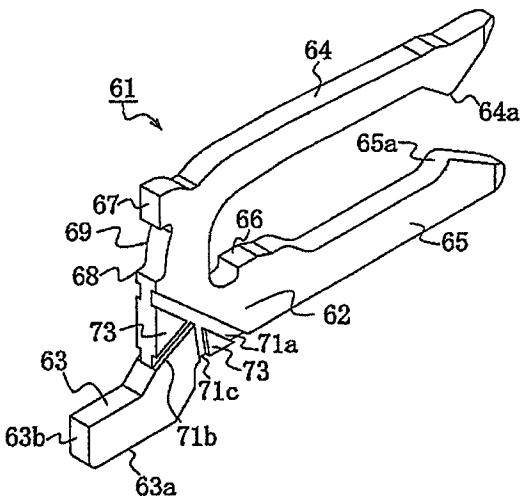
FIG. 6B is a perspective view of the terminal of FIG. 6A but taken from a different angle.
Figure 6A:
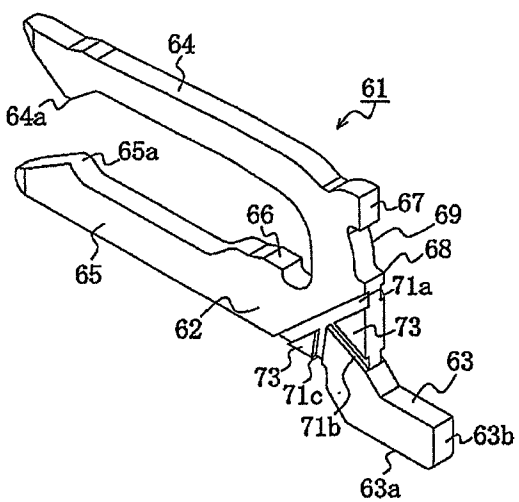
FIG. 6A is a perspective view of one of terminals contained in the connector of FIG. 1 taken from a first angle.
Figure 7:
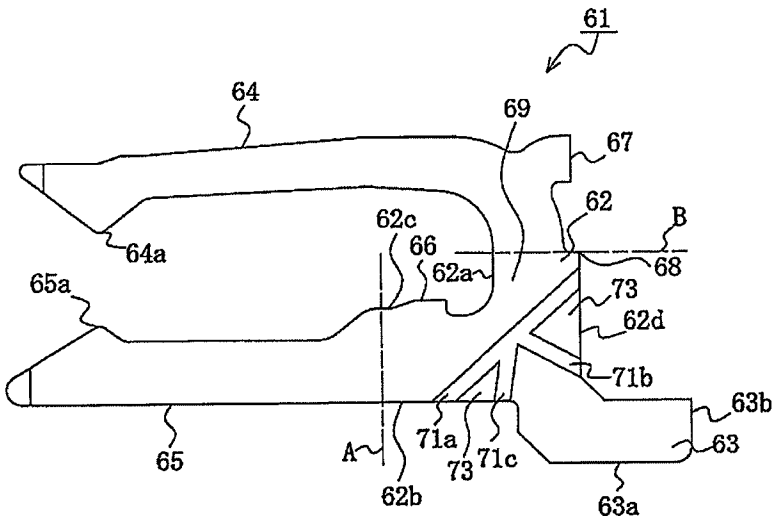
FIG. 7 is a side view of the terminal of FIG. 6A.
Figure 8:
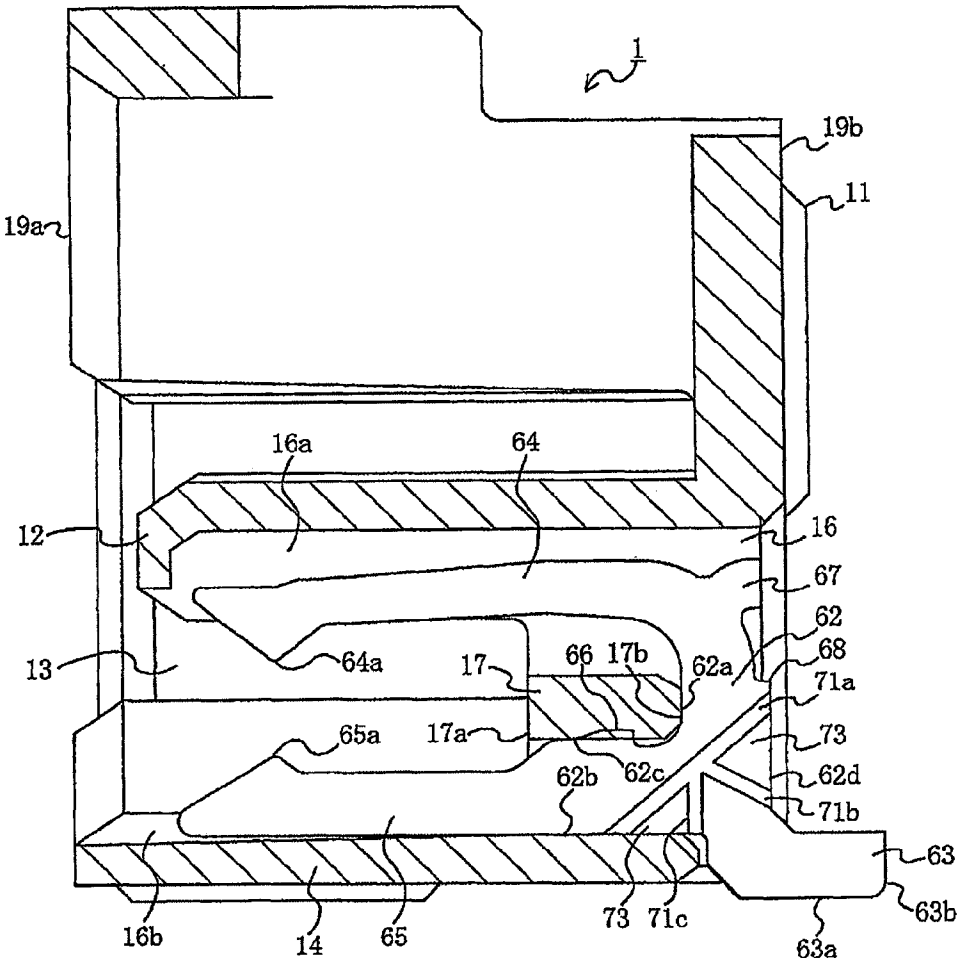
FIG. 8 is an enlarged cross-sectional view of the terminal and housing of the first embodiment of the Present Invention, in a state where the terminal is positioned in a terminal receiving cavity, taken generally along line Z-Z of FIG. 5B.

Referring now to FIGS. 6-8, terminals 61 are press-fit into their respective terminal receiving cavities 16 from the rear of housing 11 (from the right as viewed in FIG. 8). Upper arm part 64 is accommodated in upper terminal receiving cavity 16*a* and lower arm part 65 is accommodated in lower terminal receiving cavity 16*b*. Upper contact portion 64*a* protrudes downward and is formed at a free end of upper arm part 64 in close proximity to the tip of upper arm part 64. Lower contact portion 65*a* protrudes upward and is formed at a free end of lower arm part 65 in close proximity to the tip of lower arm part 65. As best seen in FIG. 8, upper contact portion 64*a* protrudes downward below the lower surface of partition plate 12, and is positioned in terminal insertion space 13*a*. The upper end of lower contact portion 65*a* protrudes upward above the upper surface of bottom wall 14, and is positioned in terminal insertion space 13*a*. When cable connector 101 is mated to board connector 1, mating contact portion 162 inserted into terminal insertion space 13*a* is disposed between upper contact portion 64*a* of upper arm part 64 and lower contact portion 65*a* of lower arm part 65 in the vertical direction. The upper surface of mating contact portion 162 contacts upper contact portion 64*a* and the lower surface of contact portion 162 contacts lower contact portion 65*a*. Through this configuration, mating contact portions 162 and terminals 61 come into contact and are electrically connected to each other with redundant points of contact. That is, a multi-point connection is provided between terminal 161 and terminal 61, thus stabilizing and improving the contact between terminal 161 and terminal 61.

Solder tail 63 has an elongated shape that protrudes rearward past the lower end of rear surface 19*b* of housing 11. Lower surface 63*a* is configured to oppose a contact pad on the surface of board 91 and is longer than rear surface 63*b* is tall. The lower surface 63*a* is positioned below the lower surface of housing 11. This allows solder tails 63 to be securely connected to the contact pads on the surface of board 91 via soldering.

Remaining projection 67 is a remnant of a coupling part remaining on terminal 61 from a carrier member (not shown) configured to hold a plurality of terminals 61 during the process of manufacturing respective terminals 61. Thus, remaining projection 67 is an accompaniment formed in the process of manufacturing terminals 61 and is not essential. If desired, remaining projection 67 may be eliminated or reduced in size.

As shown in FIG. 8, housing 11 includes terminal supporting portion 17 arranged between partition plate 12 and bottom wall 14 in terminal receiving cavity 16. Terminal supporting portion 17 has a dimension in a front-to-rear direction (a lateral direction in FIG. 8) smaller than half that of partition plate 12 or bottom wall 14 and is arranged in terminal receiving cavity 16 near rear surface 19*b*.

When terminals 61 are press-fit into their terminal receiving cavities 16, engaging projection 66 protruding upward from upper end 62*c* of base part 62 of terminal 61 in close proximity to a connecting section to lower arm part 65 is engaged or skives into the lower surface of terminal supporting portion 17 and is restrained thereto. Upper end 62*c* and lower end 62*b* of base part 62 are respectively pressed against the lower surface of terminal supporting portion 17 and upper surface of bottom wall 14. In other words, base part 62 is disposed between terminal supporting portion 17 and bottom wall 14 in a vertical direction and is thus securely held in terminal receiving cavity 16.

When terminal 61 is press-fit into terminal receiving cavity 16, front end 62*a* of base part 62 abuts against rear end surface 17*b* of terminal supporting portion 17 to position terminal 61 in a front-to-back or insertion direction. Front end surface 17*a* of terminal supporting portion 17 abuts against a tip of connecting projection 118 or counterpart contact portion 162, thus providing a stop surface to define the depth to which connecting projection 118 and mating contact portion 162 may be inserted into terminal insertion space 13*a*.

As shown in FIG. 8, upper arm part 64 and lower arm part 65 are not restrained in a vertical direction and are thus displaceable vertically within a range where upper arm part 64 and lower arm part 65 do not abut against the lower surface of partition plate 12 nor the upper surface of bottom wall 14. Each of upper arm part 64 and lower arm part 65, respectively, functions as a cantilever-shaped spring member whose rear end is restrained by base part 62. The tips of both of upper arm part 64 and lower arm part 65 are formed as a free end and thus allow upper contact portion 64*a* and lower contact portion 65*a* to be elastically displaceable vertically by way of upper arm part 64 and lower arm part 65 acting as spring members. As a result, upper contact portion 64*a* and lower contact portion 65*a* are pressed against the upper surface and the lower surface of mating contact portion 162 to maintain good contact therewith.

Upper arm part 64 and lower arm part 65 are integrally formed with base part 62 so that the boundary between such components is not well defined. As an approximation, Line A in FIG. 7 could be considered approximately a boundary between lower arm part 65 and base part 62 and Line B could be considered approximately the boundary between upper arm part 64 and base part 62. In other words, the portion to the left side of Line A is lower arm part 65 functioning as a lower spring member and the portion above Line B is upper arm part 64 functioning as an upper spring member. Reference numeral 68 represents an upper rear end of base part 62 that is the boundary between base part 62 and upper arm part 64.

Typically, when solder tail 63 of terminal 61 is soldered to the contact pad on the surface of board 91, flux wicking occurs wherein flux contained in the solder paste is melted and rises along the surfaces of terminal 61. Since flux has insulating properties, if it adheres to the surfaces of upper arm part 64 and lower arm part 65, electrical continuity with mating contact portion 162 will be degraded or broken. Thus, the surface of terminal 61 on which flux rises is mainly a side surface. If flux adheres to the side surfaces of upper arm part 64 and lower arm part 65 and the side surfaces of upper terminal receiving cavity 16*a* and lower terminal receiving cavity 16*b*, upper and lower arm parts 64, 65 may be restrained by partition plate 12 and bottom wall 14 and vertical displacement of the arm parts may be impaired.

Flux wicking is prevented or minimized by including first groove or channel 71*a*, second groove or channel 71*b* and third groove or channel 71*c* in the side surfaces of base part 62. Flux-wicking occurs mainly by capillary action. The capillary action occurs in a minute gap between the side surface of terminal 61 and the side surface of terminal receiving cavity 16. Due to the grooves, the gap between the side surfaces of the terminal (namely first groove 71*a*, second groove 71*b* or third groove 71*c*) and the side surfaces of terminal receiving cavity 16 is enlarged to suppress flux-wicking attributable to the capillary action. Even when molten flux rises from the side surface of solder tail 63 during soldering, the capillary action is unlikely to occur in each of first groove 71*a*, second groove 71*b* and third groove 71*c*, thus suppressing further movement of flux. That is, first groove 71*a*, second groove 71*b* and third groove 71*c* prevent or ward off movement of flux caused by the capillary action. As shown in FIGS. 6A and 6B, first groove 71*a*, second groove 71*b* and third groove 71*c* are equally formed in both side surfaces of base part 62. First groove 71*a*, second groove 71*b* and third groove 71*c* may be described individually or collectively as groove or grooves 71.

To minimize any movement of flux caused by the capillary action, it is desirable to enlarge the gap between the side surface of terminal 61 and the side surface of terminal receiving cavity 16. An alternative approach may be a recess part formed in the side surface of terminal receiving cavity 16 instead of groove 71. However, for the current dimension of the components, this is not an approach of choice. Housing 11 is formed of a material such as a synthetic resin and has lower strength than terminal 61 formed from sheet metal. Forming recesses in the housing similar to grooves 71 in housing 11 will considerably reduce the strength of a section between adjacent terminal receiving cavities 16. In particular, when the pitch or spacing between terminal receiving cavities 16 is small, the section between adjacent terminal receiving cavities 16 is thin. Forming a recess therein reduces the already thin section and considerably lowers the strength. Furthermore, such recesses will further complicate the structure of the mold used to mold housing 11, thus adding to the manufacturing cost of housing 11. For these reasons, groove 71 formed in terminal 61 is preferred.

Groove 71 is desirably formed by recessing the side surface of base part 62 by way of press forming or stamping during the process of stamping the terminals. Groove 71 is intended to prevent or reduce the amount of flux passing by base part 62 from solder tail 63 and reaching upper arm part 64 and lower arm part 65. Thus, groove 71 extends in the direction crossing the flow from solder tail 63 toward upper arm part 64 and lower arm part 65, across the entire width of the side surface of base part 62. That is, groove 71 is formed, in the side surface of base part 62, so as to connect lower end 62*b* and rear end 62*d* of base part 62. The width and depth of grooves 71 are determined as required in consideration of factors such as the strength of base part 62.

On each side surface of base part 62, each of grooves 71, that is, first groove 71*a*, second groove 71*b* and third groove 71*c* are formed non-parallel to each other. In the illustrated example, first groove 71*a*, second groove 71*b* and third groove 71*c* are respectively linear grooves extending in directions at an angle with respect to each other. Second groove

71*b* and third groove 71*c* each has one end connected to first groove 71*a* and is at a different angle to first groove 71*a*. This forms grooves 71 in a substantially K-shape as a whole.

By forming the plurality of grooves 71 non-parallel to each other, the strength of base part 62 does not drop considerably. Since the dimension in the thickness direction is reduced at groove 71, forming groove 71 somewhat lowers the strength of base part 62. If a plurality of grooves were formed parallel to each other, the strength of base part 62 would drop considerably. If a force acted to bend base part 62 in a direction orthogonal to a plurality of parallel grooves, base part 62 may be bent easily. In the present embodiment, plurality of grooves 71*a*, 71*b* and 71*c* extend in directions angled with respect to each other, rather than parallel to each other. As a result, if a force acting to bend base part 62 in a direction orthogonal to grooves 71 is exerted on base part 62, base part 62 is less likely to be bent. It is thus possible to sufficiently maintain the strength of base part 62, and furthermore the strength of terminal 61.

Thickened triangular parts 73 are formed between first groove 71*a* and to second groove 71*b* and between first groove 71*a* and third groove 71*c*. The dimension of thickened part 73 in the thickness direction is greater than the dimension of first groove 71*a*, second groove 71*b* or third groove 71*c* in the thickness direction although substantially the same as the dimension of the remaining area if terminal 61, that is, the section where groove 71 is not formed in the thickness direction. Thickened part 73 exists between adjacent grooves 71. When a change in a gap between the side surface of terminal 61 and the side surface of terminal receiving cavity 16 is considered with respect to the direction of flow from solder tail 63 to upper arm part 64 and lower arm part 65, a narrow section and a wide section appear alternately, which exhibits a similar effect as a labyrinth seal mechanism. As a result, the flow of flux from solder tail 63 to upper arm part 64 and lower arm part 65 is effectively warded off or prevented by the labyrinth effect.

Desirably, grooves 71 are formed in the side surface of base part 62 alone and not on upper arm part 64 and lower arm part 65. In FIG. 7, grooves 71 are desirably not formed to the left of line A and above line B. Grooves 71 have a function to accommodate and trap flux therein, thus preventing and minimizing flux-wicking. If grooves 71 were positioned on upper arm part 64 or lower arm part 65, solidification of flux trapped in grooves 71 could restrain upper arm part 64 or lower arm part 65 against partition plate 12 and bottom wall 14, thus preventing unimpeded vertical displacement of upper arm part 64 or lower arm part 65. The strength of base part 62 is somewhat reduced by grooves 71, but the presence of grooves 71 on upper arm part 64 or lower arm part 65 potentially degrades the function of upper arm part 64 or lower arm part 65 as a spring member.

In this way, plurality of grooves 71 or a pair of channels are formed non-parallel to each other in the side surface of base part 62 between solder tail 63 of terminal 61 and upper arm part 64 and lower arm part 65. This structure effectively reduces flux-wicking from solder tail 63 to upper arm part 64 and lower arm part 65 as well as sufficiently maintains the strength of terminal 61 with a simple structure.

Grooves 71 generally create a pair of obstacles that extend in a direction across the paths between solder tail 63 to upper arm part 64 and lower arm part 65, respectively. Grooves 71 cross the path along which flux would flow from solder tail 63 toward upper arm part 64 and lower arm part 65, thus reducing the likelihood of flux-wicking. At least one of grooves 71 is formed so as to connect one end of base part 62, that is, lower end 62*b* and the other end, that is, rear end 62*d*.

In addition to preventing flux-wicking as described above, solder wicking typically will also be prevented. Molten flux has a higher flowability than molten solder and thus rises along the surface of terminal 61 faster than molten solder. As a result, if sufficient structure is provided to prevent flux wicking, such structure should also prevent solder wicking.

Figure 9B:
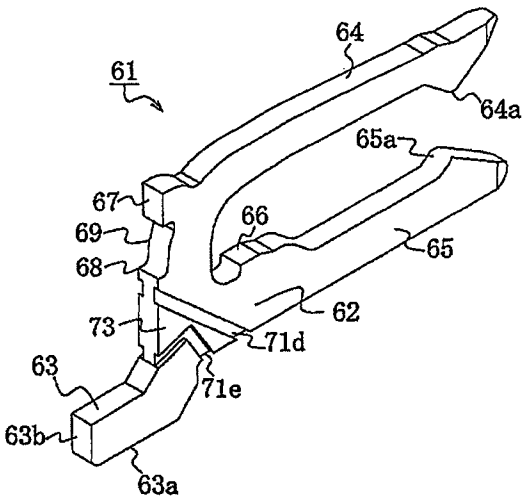
FIG. 9B is a perspective view of the terminal of FIG. 9A but taken from a different angle.
Figure 9A:
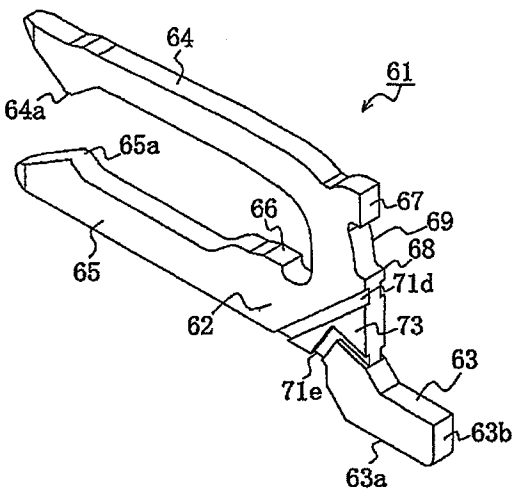
FIG. 9A is a perspective view of one of terminals according to a second embodiment of the Present Invention taken from a first angle.
Figure 10:
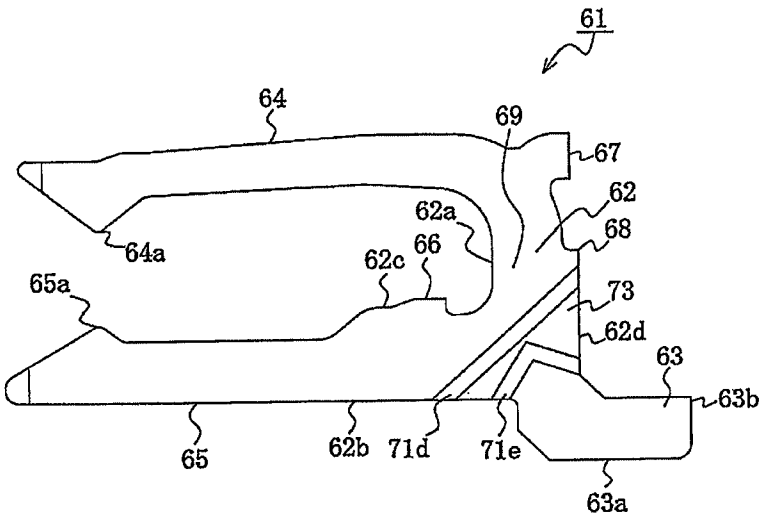
FIG. 10 is a side view of the terminal of FIG. 9A.

Referring to FIGS. 9-10, a further embodiment is disclosed. In this embodiment, fourth groove 71*d* and fifth groove 71*e*, defining an assembly of grooves 71, are formed in each side surface of base part 62. Fourth groove 71*d* is a linearly extending groove formed to linearly connect lower end 62*b* and rear end 62*d* of base part 62, similar to first groove 71*a* in the first embodiment. Fifth groove 71*e* is a groove having a shape of a polygonal line made by connecting two straight line segments. Fifth groove 71*e* is formed to connect lower end 62*b* and rear end 62*d* of base part 62 immediately adjacent solder tail 63. Any of the sections corresponding to two line segments of fifth groove 71*e* tilts with respect to fourth groove 71*d*. In other words, fifth groove 71*e* is formed non-parallel to fourth groove 71*d* in any section thereof. Thickened part 73 is formed between fourth groove 71*d* and fifth groove 71*e*. With this structure, fourth groove 71*d* and fifth groove 71*e* are formed to be non-parallel to each other, thus enjoying the same advantages as that of first groove 71*a*, second groove 71*b* and third groove 71*c* in the previous embodiment.

While one of two grooves 71 is a linearly extending groove and the other is a polygonal-line groove in this embodiment, both grooves may be linearly extending grooves or polygonal-line grooves as long as the grooves are substantially non-parallel to each other. One or both of two grooves 71 may have a shape of a curve. While the number of grooves 71 is two in this embodiment, the number of grooves 71 may also be three or more.

Figure 11:
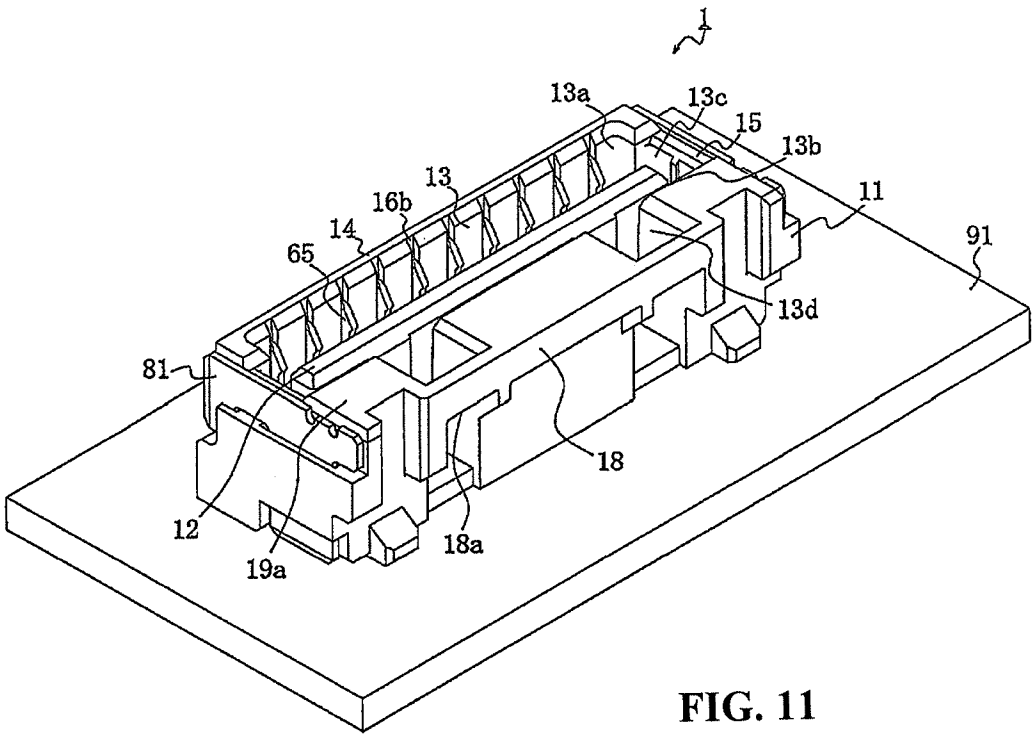
FIG. 11 is a perspective view of a connector according to a third embodiment of the Present Invention.
Figure 12:
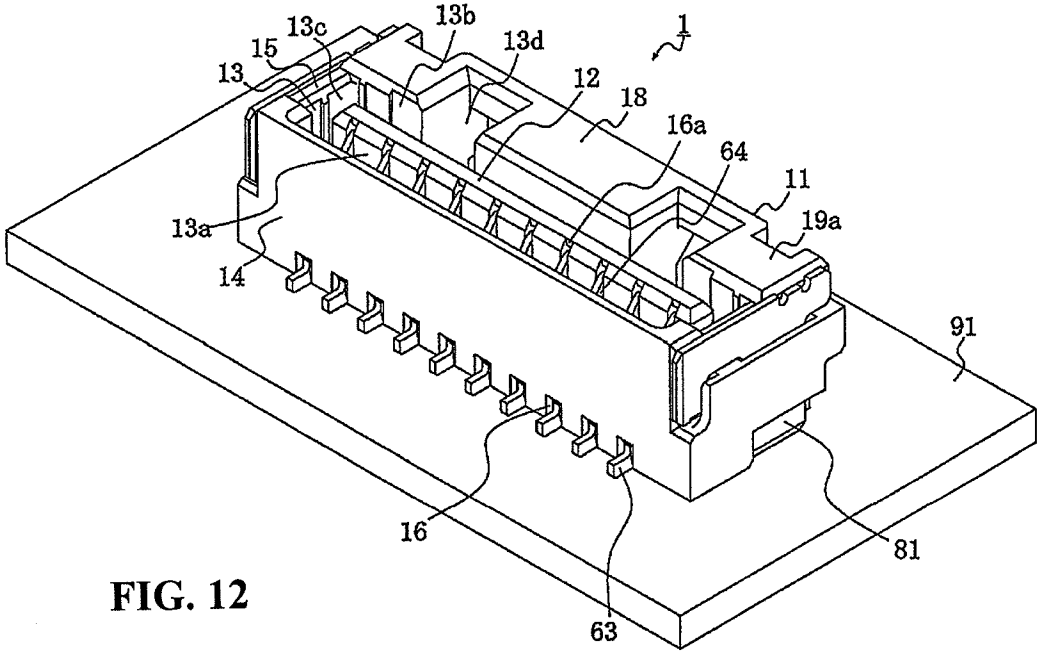
FIG. 12 is a perspective view of the connector of FIG. 11 but taken from a different angle.

A further embodiment of the Present Invention is shown in FIGS. 11-4. In this embodiment, board connector 1 is configured as a so-called straight type or vertical connector. In this case, board connector 1 is mounted, with insertion opening 13 facing upward, with front surface 19*a* of housing 11 facing upward and being parallel to the surface of board 91, and with rear surface 19*b* of housing 11 facing downward and opposed to the surface of board 91.

Figure 13B:
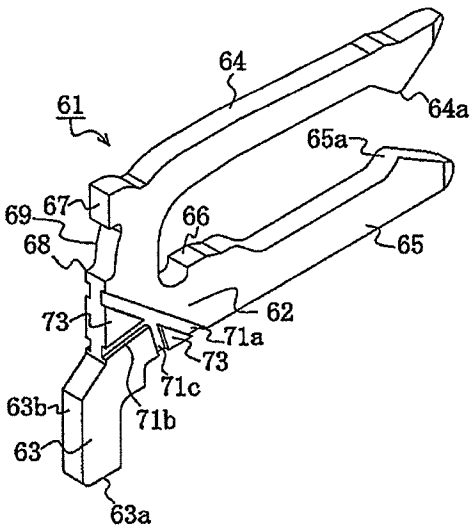
FIG. 13B is a perspective view of the terminal of FIG. 13A but taken from a different angle.
Figure 13A:
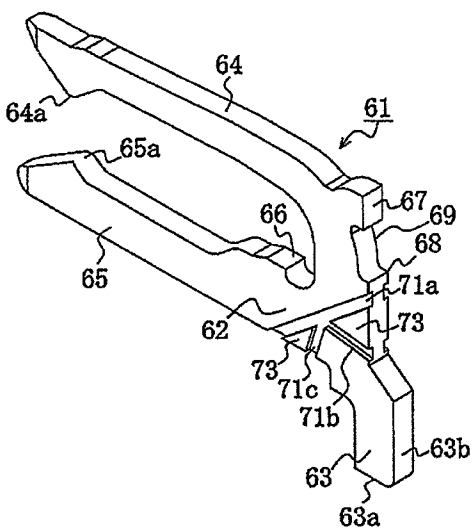
FIG. 13A is a perspective view of one of terminals contained in the connector of FIG. 11 taken from a first angle.
Figure 14:
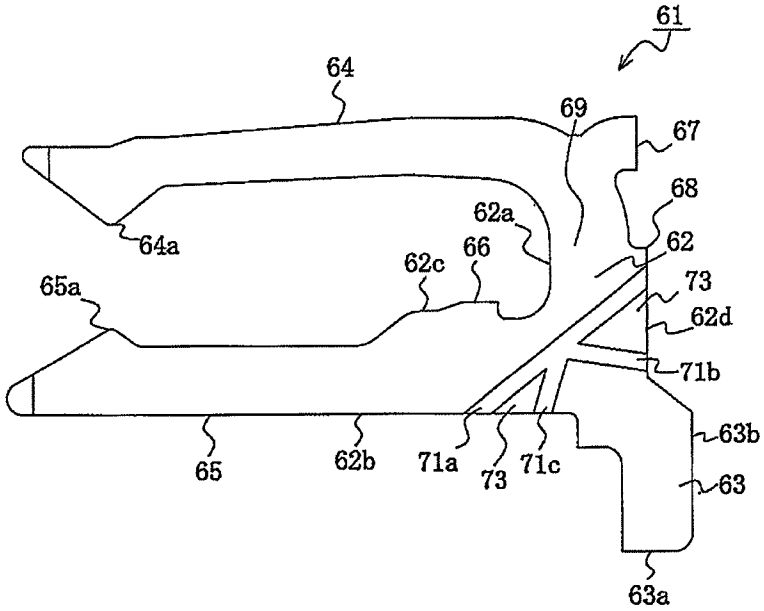
FIG. 14 is a side view of the terminal of FIG. 13A.
Figure 15:
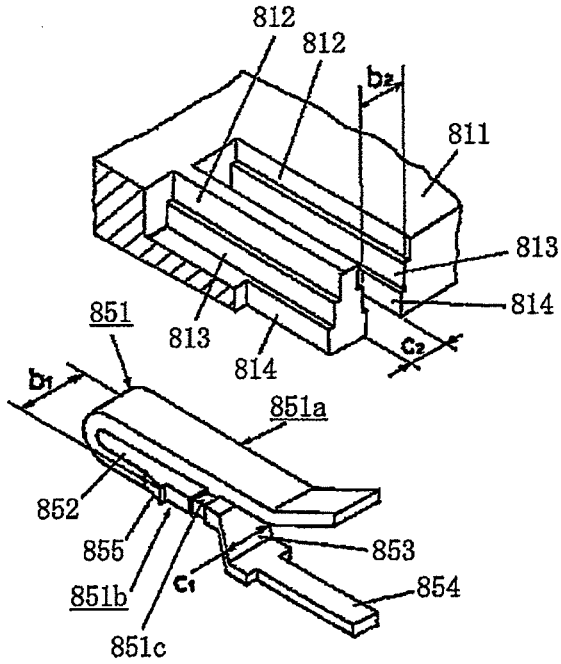
Prior art FIG. 15
FIG. 15 is a perspective view of a terminal and a section of a body member that receives such terminal according to the prior art.

Terminal 61 of this embodiment is shown in FIGS. 13-4. This embodiment differs from the previous embodiments in that solder tail 63 is formed to extend downward from the lower rear end of base part 62. When terminal 61 is mounted on housing 11, solder tail 63 protrudes out from the side of rear surface 19*b* of housing 11 and is exposed outside. Solder tail 63 is essentially at a right angle to those of the first and second embodiments. However, housing 11 and terminal receiving cavities 16 are also at a right angle to those of the first and second embodiments. Rear surface 63*b* is positioned rearward from rear surface 19*b* of housing 11.

In this embodiment, board connector 1 is mounted on board 91 with rear surface 19*b* of housing 11 facing downward. Thus, rear surface 63*b* of solder tail 63 is soldered to and opposed to the contact pad on the surface of board 91.

The configuration of terminal 61 other than solder tail 63 is the same as that of terminal 61 in the first embodiment and therefore the features thereof are not described in more detail herein. Furthermore, the remaining configuration of board connector 1 is the same as the first embodiment and therefore it is not described in more detail herein.

The foregoing description has been presented for purposes of illustration and description. It is not intended to be exhaustive or to limit the invention to the precise forms that are disclosed. Modifications and variations are possible in light of the above teachings. The embodiments discussed, however, were chosen and described to provide the best illustration of the principles of the invention and its practical application to thereby enable one of ordinary skill in the art to utilize the invention in various embodiments and with various modifications as are suited to the particular use contemplated.

What is claimed is:

1. An electrically conductive terminal configured for use in a connector, the electrically conductive terminal comprising:

a solder tail, the solder tail being soldered to a contact pad of a circuit member;

at least one deflectable contact arm, each deflectable contact arm engaging a counterpart terminal of a mating electrical component; and a body, the body being provided between and connecting the solder tail and the deflectable contact arm, the body including a pair of side edges and oppositely facing side surfaces;

wherein each side surface has a pair of non-parallel channels therein, at least one of the non-parallel channels extending between the pair of side edges.

2. The electrically conductive terminal according to claim 1, further including a pair of the deflectable contact arms, wherein each channel extends in a direction across a path from the solder tail to one of the deflectable contact arms.

3. The electrically conductive terminal according to claim 2, wherein the solder tail is configured to be surface mount soldered to the contact pad.

4. The electrically conductive terminal according to claim 1, wherein both of non-parallel channels extend between the pair of side edges.

5. The electrically conductive terminal according to claim 1, wherein the electrically conductive terminal is stamped from sheet metal and is planar.

6. The electrically conductive terminal according to claim 1, wherein at least one non-parallel channel is linear.

7. The electrically conductive terminal according to claim 6, wherein each side edge is generally perpendicular to each other.

8. The electrically conductive terminal according to claim 6, further including a pair of non-parallel intersecting linear channels.

9. The electrically conductive terminal according to claim 8, wherein each non-parallel intersecting linear channel extends to one side edge.

10. The electrically conductive terminal according to claim 8, wherein each non-parallel intersecting linear channel intersects the linear channel.

11. The electrically conductive terminal according to claim 8, wherein the non-parallel intersecting linear channels are configured in a K-shape.

12. An electrical connector comprising:

a housing, the housing including an insertion opening into which a mating electrical component may be inserted and a plurality of spaced apart terminal receiving cavities; and a plurality of planar electrically conductive metal terminals , each planar electrically conductive metal terminal being stamped from sheet metal, positioned in one of the terminal receiving cavities, configured to electrically mate with a mating terminal of the mating electrical component, and including:

a pair of non-parallel intersecting linear channels;

a solder tail, the solder tail being soldered to a contact pad of a circuit member;

at least one deflectable contact arm, each deflectable contact arm engaging a counterpart terminal of a mating electrical component; and a body provided between and connecting the solder tail and the deflectable contact arm, the body including a pair of side edges and oppositely facing side surfaces;

wherein each side surface has a pair of non-parallel channels therein and each of the non-parallel channels extends to at least one of the pair of side edges.

13. The electrical connector according to claim 12, wherein each planar electrically conductive metal terminal further includes a pair of the deflectable contact arms, wherein each channel extends in a direction across a path from the solder tail to one of the deflectable contact arms.

14. The electrical connector according to claim 13, wherein the solder tail is configured to be surface mount soldered to the contact pad.

15. The electrical connector according to claim 13, wherein at least one non-parallel channel is linear.

16. The electrical connector according to claim 15, wherein each side edge is perpendicular to each other.

17. The electrical connector according to claim 15, wherein each non-parallel intersecting linear channel extends to one side edge.

18. The electrically conductive terminal according to claim 15, wherein each non-parallel intersecting linear channel intersects the linear channel.

19. The electrically conductive terminal according to claim 15, wherein the non-parallel intersecting linear channels are configured in a K-shape.

* * * * *